US010370938B2

(12) United States Patent
Patel

(10) Patent No.: US 10,370,938 B2
(45) Date of Patent: Aug. 6, 2019

(54) FLUID LOSS CONTROL COMPLETION SYSTEM AND METHODOLOGY

(71) Applicant: SCHLUMBERGER TECHNOLOGY CORPORATION, Sugar Land, TX (US)

(72) Inventor: Dinesh Patel, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 387 days.

(21) Appl. No.: 15/102,032

(22) PCT Filed: Sep. 18, 2014

(86) PCT No.: PCT/US2014/056335

§ 371 (c)(1),
(2) Date: Jun. 6, 2016

(87) PCT Pub. No.: WO2015/084455

PCT Pub. Date: Jun. 11, 2015

(65) Prior Publication Data

US 2016/0305217 A1 Oct. 20, 2016

Related U.S. Application Data

(60) Provisional application No. 61/912,314, filed on Dec. 5, 2013.

(51) Int. Cl.

| | |
|---|---|
| ***E21B 34/14*** | (2006.01) |
| ***E21B 43/08*** | (2006.01) |
| ***E21B 21/00*** | (2006.01) |
| ***E21B 33/12*** | (2006.01) |
| ***E21B 43/14*** | (2006.01) |

(Continued)

(52) U.S. Cl.

CPC ..... *E21B 34/14* (2013.01); *E21B 21/003* (2013.01); *E21B 33/12* (2013.01); *E21B 43/08* (2013.01); *E21B 43/14* (2013.01); *E21B 33/126* (2013.01); *E21B 2034/007* (2013.01)

(58) Field of Classification Search

CPC combination set(s) only.
See application file for complete search history.

(56) References Cited

U.S. PATENT DOCUMENTS 4,440,218 A 4/1984 Farley
6,302,216 B1 * 10/2001 Patel ..... E21B 21/103 166/321

(Continued)

OTHER PUBLICATIONS

Search Report and Written Opinion of International Patent Application No. PCT/US2014/056335 dated Dec. 10, 2014, 15 pages.

*Primary Examiner* — Cathleen R Hutchins
*Assistant Examiner* — Ronald R Runyan

(57) ABSTRACT

A technique provides a simplified and cost-effective approach for deployment and operation of completion systems. The construction of the overall completion system and the deployment methodology provide an efficient approach for placement and operation of completion systems in a variety of wellbores. In many applications, the system and methodology may be used for sand control applications in which the completion equipment comprises sand control features, such as sand screens deployed along well zones.

14 Claims, 10 Drawing Sheets

(51) Int. Cl.
*E21B 33/126* (2006.01)
*E21B 34/00* (2006.01)

(56) References Cited

U.S. PATENT DOCUMENTS

| | | | | |
|---|---|---|---|---|
| 6,354,378 | B1 * | 3/2002 | Patel | E21B 21/103 166/321 |
| 2001/0030049 | A1 | 10/2001 | Patel | |
| 2005/0092501 | A1 * | 5/2005 | Chavers | E21B 34/10 166/386 |
| 2006/0060352 | A1 | 3/2006 | Vidrine et al. | |
| 2011/0139465 | A1 | 6/2011 | Tibbles et al. | |
| 2013/0180735 | A1 * | 7/2013 | Patel | E21B 33/13 166/387 |

* cited by examiner

FLUID LOSS CONTROL COMPLETION SYSTEM AND METHODOLOGY

CROSS-REFERENCE TO RELATED APPLICATION

The present document is based on and claims priority to U.S. Provisional Application Ser. No. 61/912,314 filed Dec. 5, 2013, incorporated herein by reference in its entirety.

BACKGROUND

Many types of completions systems are deployed downhole in a wellbore to facilitate production of desired fluids, such as hydrocarbon fluids, from a plurality of well zones. In many applications, construction of the completion system in a wellbore may involve several trips downhole with distinct sections of the overall completion system, e.g. separate trips for a lower completion, an isolation assembly, an upper completion, and other completion sections. Each section of the overall completion system is deployed and engaged with a corresponding section or sections of the completion system. Additionally, each completion section may comprise a variety of components, including flow control components. Examples of flow control components include flow isolation valves and annular flow isolation valves.

SUMMARY

In general, a system and methodology are provided to simplify deployment and operation of a completion system. The construction of the overall completion system and the deployment methodology provide a cost-effective and efficient approach for placement and operation of the completion system in a wellbore. In many well operations, the system and methodology may be used in sand control applications in which the completion equipment comprises sand control features, such as sand screens deployed along well zones.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
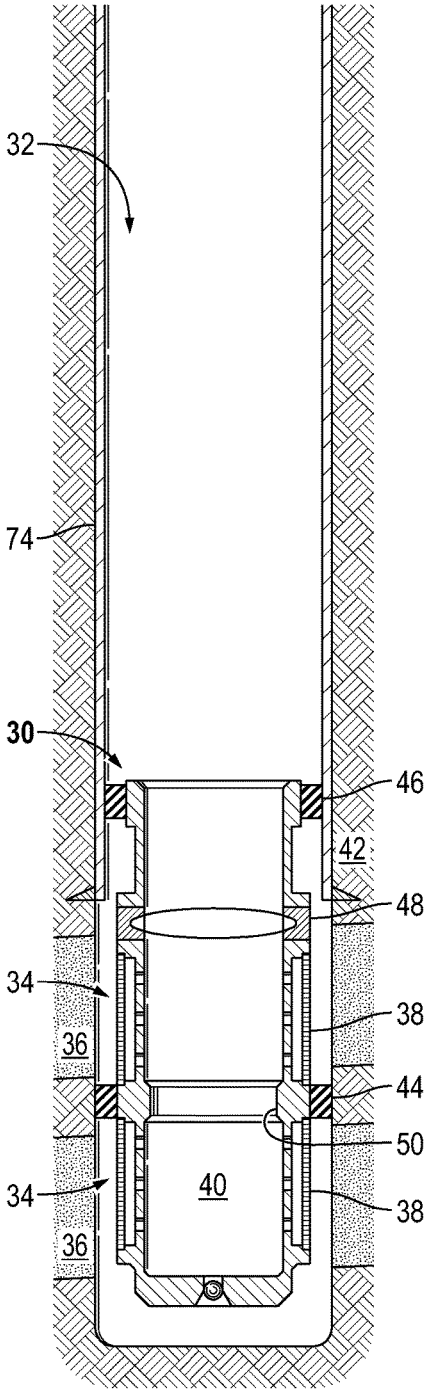
FIG. 1 is a schematic illustration of an example of a lower completion of an overall completion assembly, the lower completion having sand control assemblies, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally provides a technique to simplify deployment and operation of a completion system. The construction of the overall completion system and the deployment methodology provide a cost-effective and efficient approach for placement of the completion system in a wellbore in two trips or three trips downhole. In many applications, the system and methodology may be used for sand control in which the completion equipment comprises sand control features, such as sand screens deployed along well zones.

In some embodiments, a two trip approach is used for deploying an intelligent completion. The technique provides improved reliability and improves operation at a lower cost. Depending on the application, a conventional flow isolation valve may be replaced with a mechanical flow isolation valve that may be opened with, for example, a shifting tool. Such embodiments enable circulation on top of the closed mechanical flow isolation valve before opening of the valve. Embodiments described herein also enable construction of a completion system without certain annular fluid loss control features, such as annular flow isolation valves. Embodiments of the two trip completion enable deployment without separately deploying an intermediate completion which saves rig time. The embodiments also reduce or simplify the hardware used in the completion by removing certain conventional features, e.g. annular flow isolation valves and certain polished bore receptacles, flow isolation valves, and packers. A lower completion flow isolation valve also may be replaced by a mechanical flow isolation valve and a simple polished bore receptacle may be employed, as described in greater detail below.

In other embodiments, a three trip approach may be used for deploying an intelligent completion. In these embodiments, the system and methodology described herein similarly provide improved reliability. For example, the technique enables replacement of a conventional annular flow isolation valve with a mechanical sliding sleeve which can be shifted, e.g. opened, with a shifting tool. The system is constructed so as to present no debris trap and to enable circulation on top of the closed mechanical formation isolation valve. The three trip approach also may reduce hardware by, for example, replacing the conventional annular flow isolation valve with a sliding sleeve and by utilizing a simple polished bore receptacle, as described in greater detail below. The approach also improves accessibility by providing a larger inside diameter inner production tubing, better access to the lower completion, and a larger flow area. The two trip system and the three trip system are both amenable for use in sand control applications.

Embodiments of the two trip completion system and methodology are initially described. Referring generally to FIG. 1, an example of a lower completion 30 of a two trip completion system is illustrated as run in hole into a wellbore 32. The lower completion 30 may be a sand control completion having a plurality of sand control assemblies 34 deployed along well zones 36, e.g. along a lower well zone and an upper well zone. Each of the sand control assemblies 34 comprises a sand screen 38 which filters out particulates from well fluid which flows into an interior 40 of the completion from the surrounding formation 42, e.g. from a hydrocarbon bearing formation. In the embodiment illustrated, the lower completion 30 may further comprise an open hole isolation packer 44, an upper packer 46, and a mechanical formation isolation valve 48 disposed between the isolation packer 44 and upper packer 46. The lower completion 30 also comprises a simple polished bore receptacle 50 which may be located proximate isolation packer 44.

Figure 2:
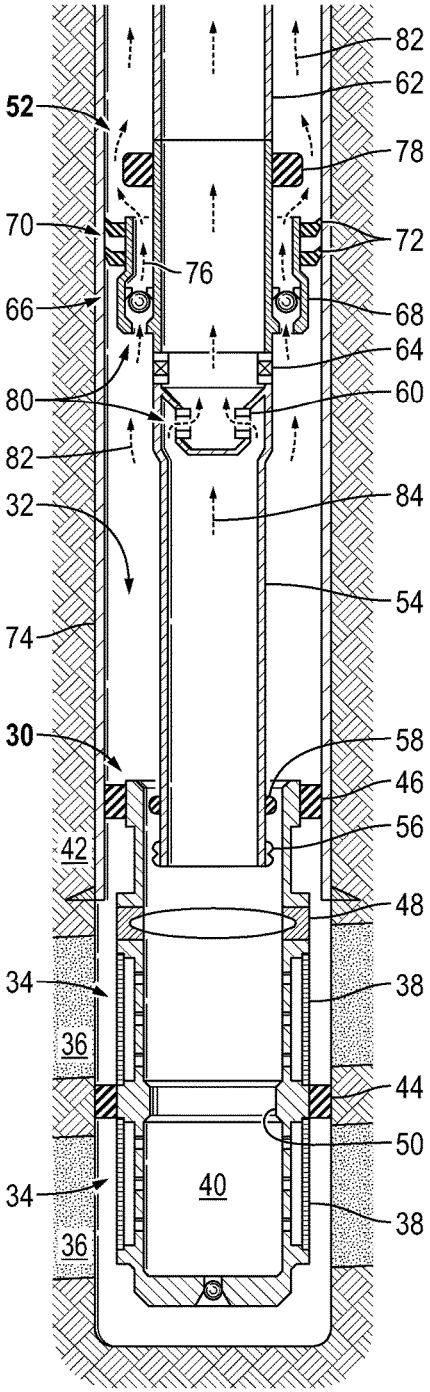
FIG. 2 is a schematic illustration of an example of an upper completion being deployed into engagement with the lower completion during a second trip downhole, the upper completion having a variety of upper completion and intelligent completion components, according to an embodiment of the disclosure.

As illustrated in FIG. 2, and upper completion 52 may be moved downhole into wellbore 32 for engagement with lower completion 30. In this example, the upper completion 52 comprises a lower tubing 54 having a shifting tool 56 for the mechanical flow isolation valve 48 and a seal assembly 58. The lower tubing 54 extends past a lower zone flow control valve 60 such that fluid flowing up through the interior of lower tubing 54 can enter a production tubing 62 through the flow control valve 60. Fluid flowing along the exterior of tubing 54 can enter the production tubing string 62 via an upper zone flow control valve 64 once the upper completion 52 is fully engaged with the lower completion 30 and production of well fluid is commenced.

The illustrated example of upper completion 52 further comprises a fluid loss control device 66 mounted along the exterior of production tubing string 62. The fluid loss control device 66 may comprise a flow restrictor or a plurality of flow restrictors 68, such as check valves or other suitable one-way flow devices. The flow restrictors 68 allow upward flow of fluid while blocking downward flow of fluid. Fluid loss control device 66 also may comprise a seal system 70 which may employ a plurality of cup packers 72. The cup packers 72 seal against an interior surface of a well casing 74 and also provide an internal flow path, as represented by arrows 76, between the production tubing string 62 and an interior of seal system 70. The upper completion 52 also may comprise a packer 78, e.g. a production packer, located uphole from the fluid loss control device 66.

The upper completion 52 may comprise a variety of additional and/or other intelligent completion and upper completion components depending on the parameters of a given application. The structure of upper completion 52 also facilitates fluid circulation by providing a fluid bypass 80. As the upper completion 52 is moved downhole toward lower completion 30, fluid in wellbore 32 is allowed to flow along the exterior of tubing 54, up through flow restrictors 68, through internal flow path 76, past the un-set production packer 78, and on up through the wellbore annulus, as represented by arrows 82. Additionally, by opening the lower zone flow control valve 60, fluid in tubing 54 is allowed to flow in through the flow control valve 60 and up through an interior of production tubing 62, as represented by arrows 84. The flow paths represented by arrows 82 and 84 establish fluid bypass 80.

Figure 3:
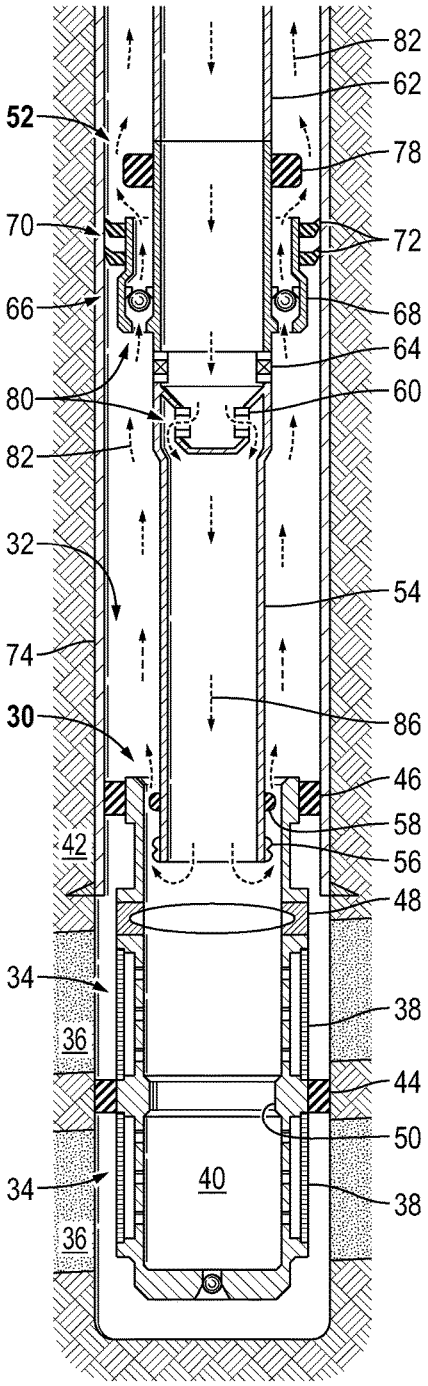
FIG. 3 is a schematic illustration of the lower completion and the upper completion in an initial operational configuration, according to an embodiment of the disclosure.

As illustrated in FIG. 3, the structure of upper completion 52 also enables fluid circulation for well control as represented by arrows 86. If desired for a given application, well fluid may be allowed to flow down through production tubing string 62, out through lower flow control valve 60, down through tubing 54, and around to the exterior of tubing 54. The fluid is then free to continue its travel up through flow restrictors 68, along internal flow path 76, past production packer 78, and up along the wellbore annulus.

Figure 4:
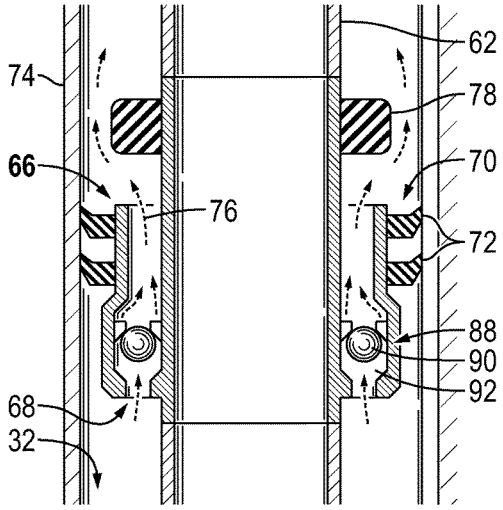
FIG. 4 is a schematic illustration of an example of a fluid loss control device which may be utilized in the upper completion, according to an embodiment of the disclosure.
Figure 5:
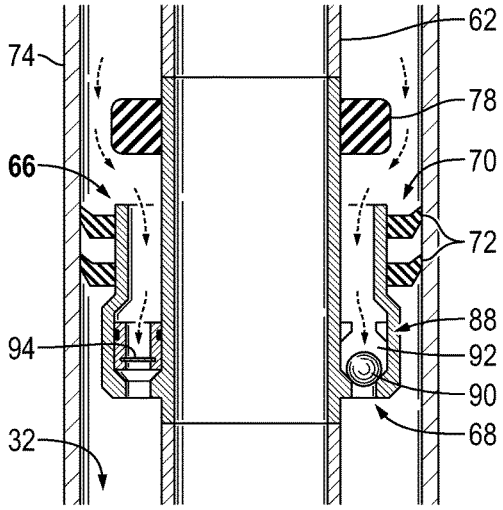
FIG. 5 is a schematic illustration of another example of the fluid loss control device, according to an embodiment of the disclosure.

A variety of flow restrictors 68 and seal elements, e.g. cup packers 72, may be used in fluid loss control device 66. By way of example, the flow restrictors 68 may comprise a plurality of check valves 88, as illustrated in the enlarged view of FIG. 4. In this example, each check valve 88 is a ball-type check valve having a ball 90 which moves in a cavity 92 between a position allowing upward fluid flow and a position blocking downward fluid flow. In some applications, the fluid loss control device 66 also may comprise at least one rupture disc 94, as illustrated in FIG. 5. The rupture disc or discs 94 enable establishment of a fluid pathway in the event flow restrictors 68 become disabled or a situation develops that would benefit from top to bottom fluid flow past fluid loss control device 66. The rupture disc 94 may be ruptured by applying sufficient pressure in the wellbore annulus.

Figure 6:
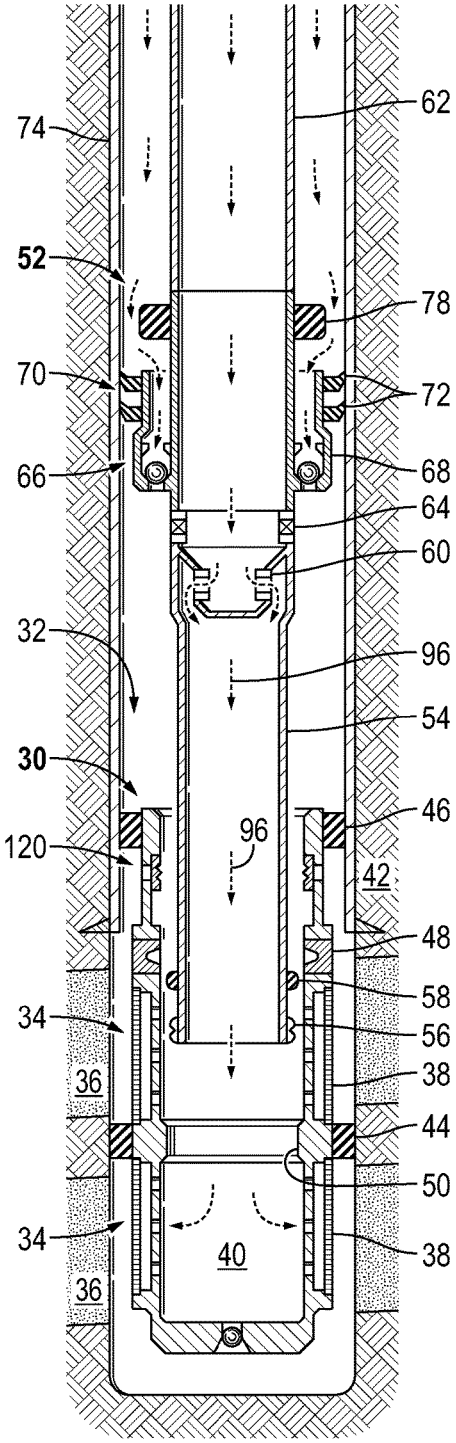
FIG. 6 is a schematic illustration of the lower completion and the upper completion in another operational configuration, according to an embodiment of the disclosure.
Figure 7:
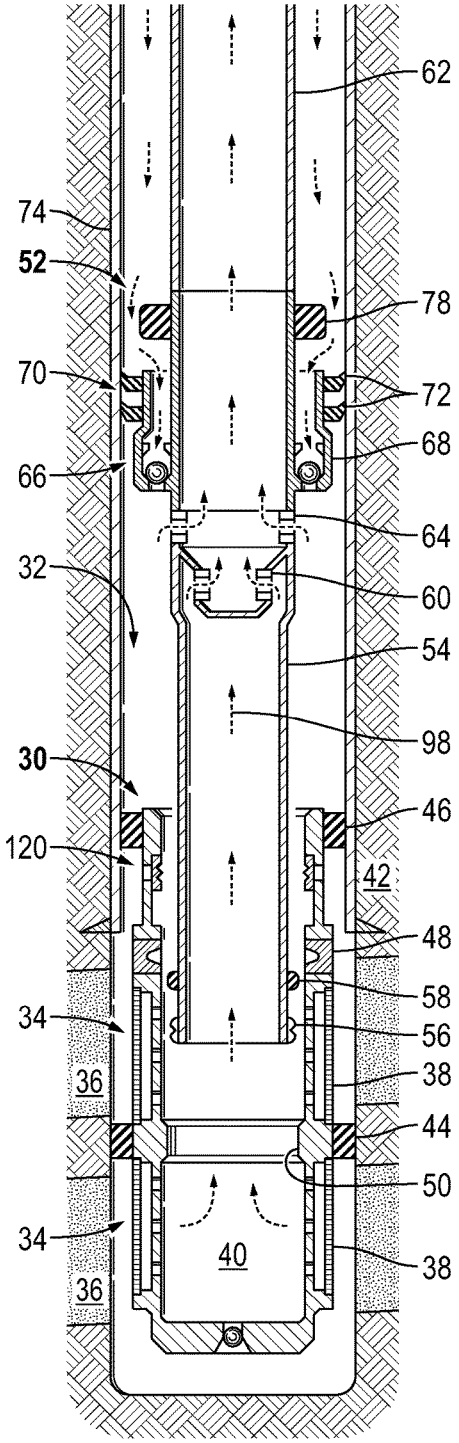
FIG. 7 is a schematic illustration of the lower completion and the upper completion in another operational configuration, according to an embodiment of the disclosure.

As illustrated in FIG. 6, an option to provide fluid loss control is to bullhead fluid below the lower flow control valve 60 and the fluid loss control device 66 into the surrounding formation 42 after the mechanical flow isolation valve 48 has been opened via passage of shifting tool 56. The fluid is flowed down through production tubing string 62, down through tubing 54, and out through screen assemblies 34, as represented by arrows 96. However, another option is to open both lower zone flow control valve 60 and upper zone flow control valve 64. This latter option enables the taking of returns through production tubing string 62 after the mechanical flow isolation valve 48 has been opened by shifting tool 56, as illustrated in FIG. 7. The flow of returns to production tubing string 62 is represented by arrows 98 in FIG. 7.

Figure 8:
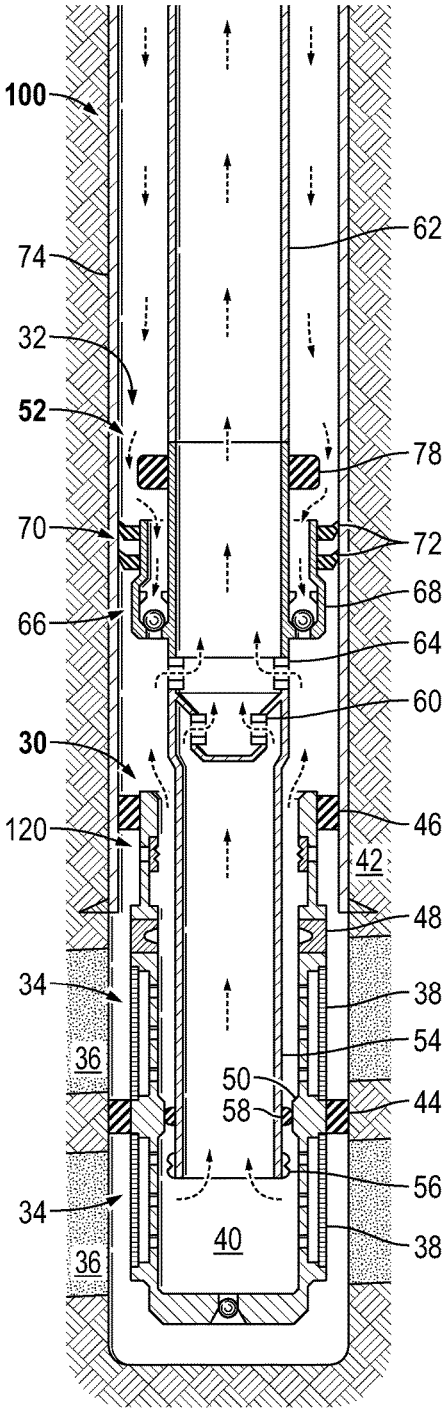
FIG. 8 is a schematic illustration of the lower completion and the upper completion in another operational configuration, according to an embodiment of the disclosure.
Figure 9:
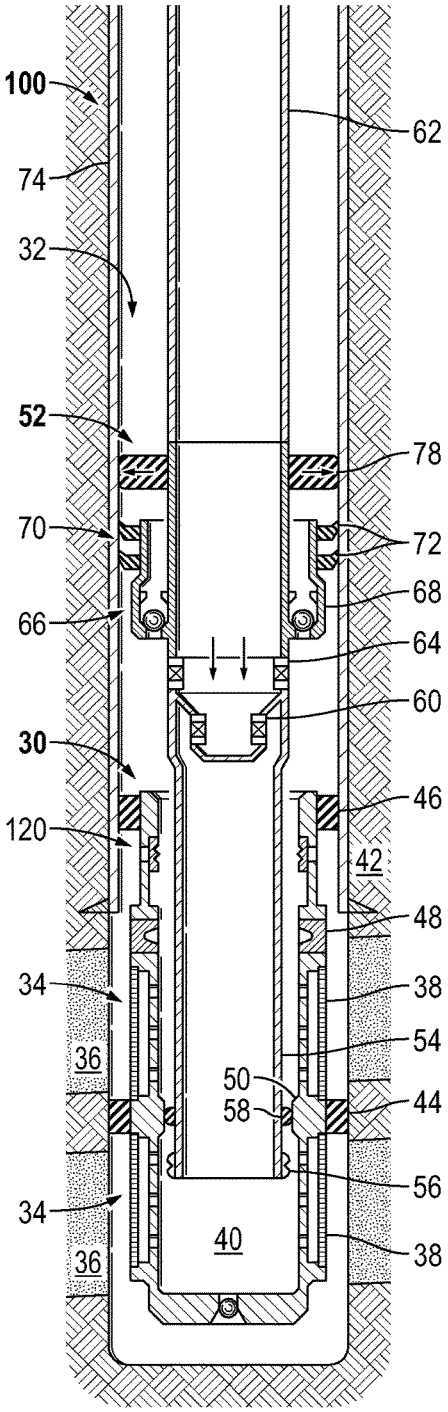
FIG. 9 is a schematic illustration of the lower completion and the upper completion in another operational configuration, according to an embodiment of the disclosure.

Continued movement of upper completion 52 into engagement with lower completion 30 causes movement of seal assembly 58 into polished bore receptacle 50 of lower completion 30, as illustrated in FIG. 8, to form an overall completion system 100 in two trips. Seal assembly 58 forms a seal between tubing 54 of upper completion 52 and lower completion 30. As the seal assembly 58 is engaged and sealed with respect to polished bore receptacle 50, the lower zone flow control valve 60 is open. If the system employs a completion tubing hanger, the tubing hanger (located farther uphole) also may be fully landed. After the upper completion 52 is sealably engaged with the lower completion 30, the lower flow control valve 60 may be closed with upper flow control valve 64 to enable application of pressure along the interior of production tubing string 62. The pressure in production tubing string 62 is sufficiently increased to set production packer 78 against the inside of well casing 74, as illustrated in FIG. 9.

Figure 10:
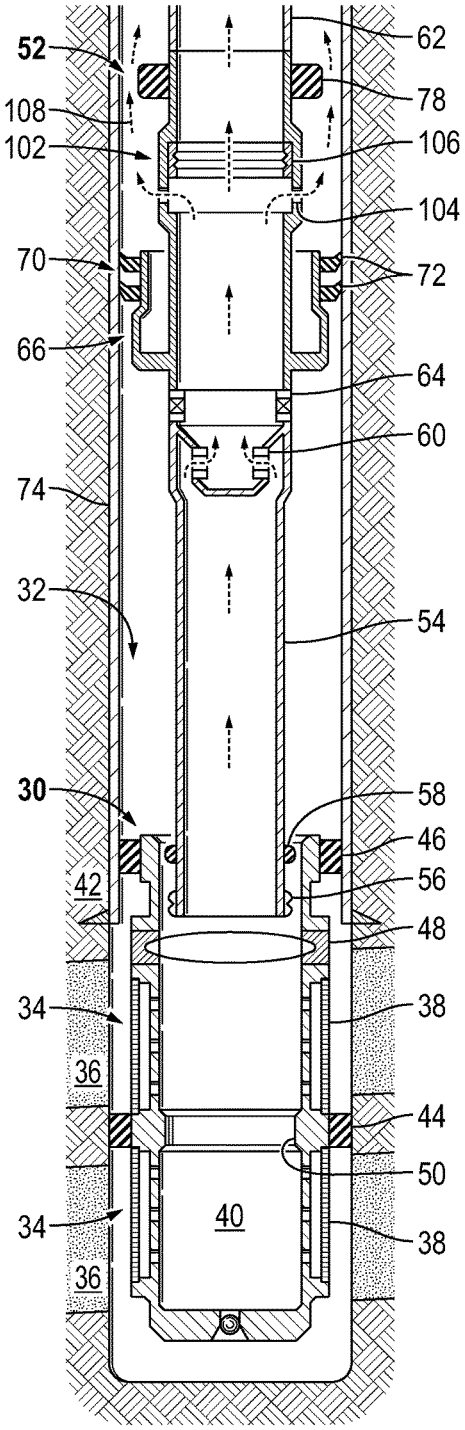
FIG. 10 is a schematic illustration of another embodiment of the lower completion and the upper completion in another operational configuration, the embodiment comprising a two trip completion having fluid loss control and well control, according to an embodiment of the disclosure.

Referring generally to FIG. 10, another embodiment of a two trip completion system is illustrated. In this embodiment, an on/off flow control valve 102 is disposed along the exterior of production tubing 62 between fluid loss control device 66 and production packer 78. In this example, the on/off flow control valve 102 provides a flow passage 104 between the interior of production tubing string 62 and the surrounding annulus. The flow passage 104 may be selectively opened or closed via a sliding sleeve 106 or other suitable device. In the embodiment illustrated in FIG. 10, the fluid loss control device 66 is constructed without flow restrictors 68. As the upper completion 52 is moved down into engagement with the lower completion 30, the on/off flow control valve 102 may be open to allow fluid to flow up through tubing 54, through lower flow control valve 60, into production tubing 62, out through flow passage 104, past production packer 78, and along the wellbore annulus, as represented by arrows 108.

Figure 11:
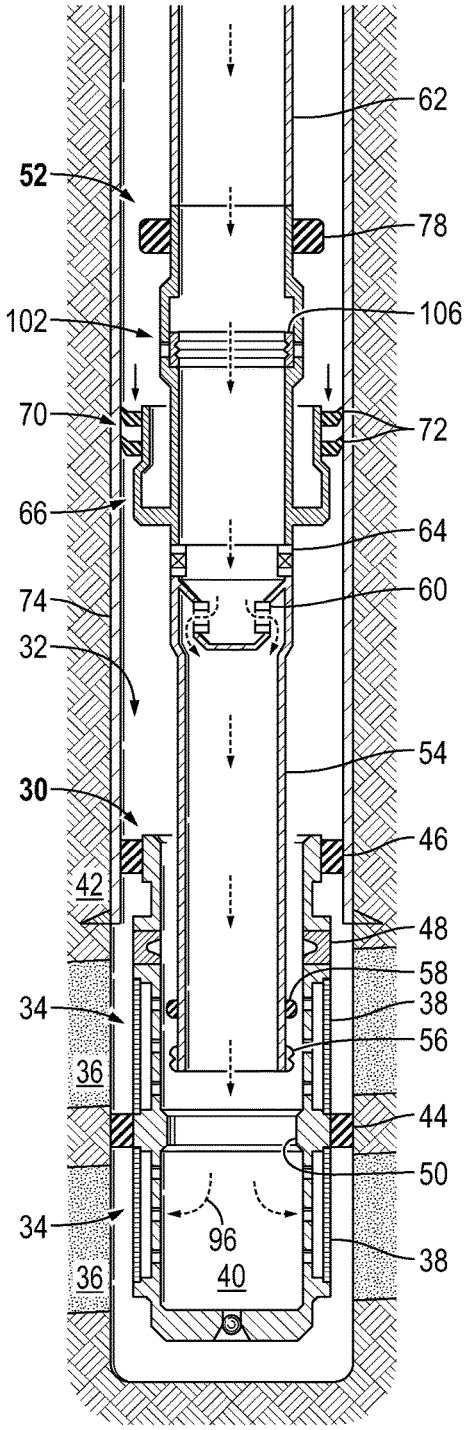
FIG. 11 is a schematic illustration of the embodiment illustrated in FIG. 10 in another operational configuration, according to an embodiment of the disclosure.
Figure 12:
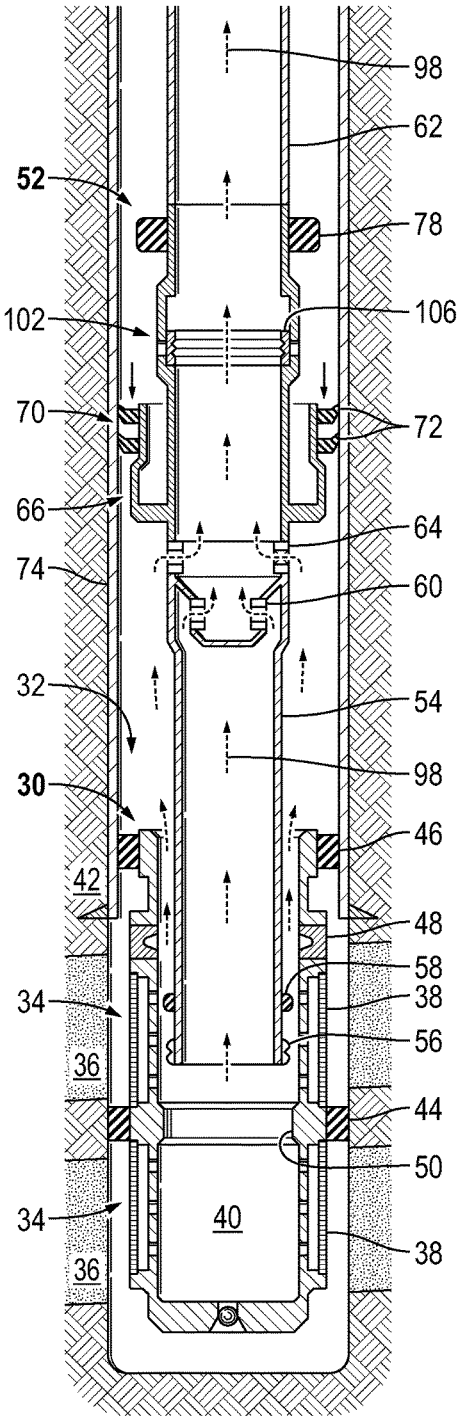
FIG. 12 is a schematic illustration of the embodiment illustrated in FIG. 10 in another operational configuration, according to an embodiment of the disclosure.

As illustrated in FIG. 11, an option to provide fluid loss control is to bullhead fluid below the lower flow control valve 60 and the fluid loss control device 66 into the surrounding formation 42 after the mechanical flow isolation valve 48 has been opened via passage of shifting tool 56. The fluid is flowed down through production tubing string 62, down through tubing 54, and out through screen assemblies 34, as represented by arrows 96. However, another option is to open both lower zone flow control valve 60 and upper zone flow control valve 64. This latter option again enables the taking of returns through production tubing string 62 after the mechanical flow isolation valve 48 has been opened by shifting tool 56, as illustrated in FIG. 12. The flow of returns to production tubing string 62 is represented by arrows 98 in FIG. 12.

Figure 13:
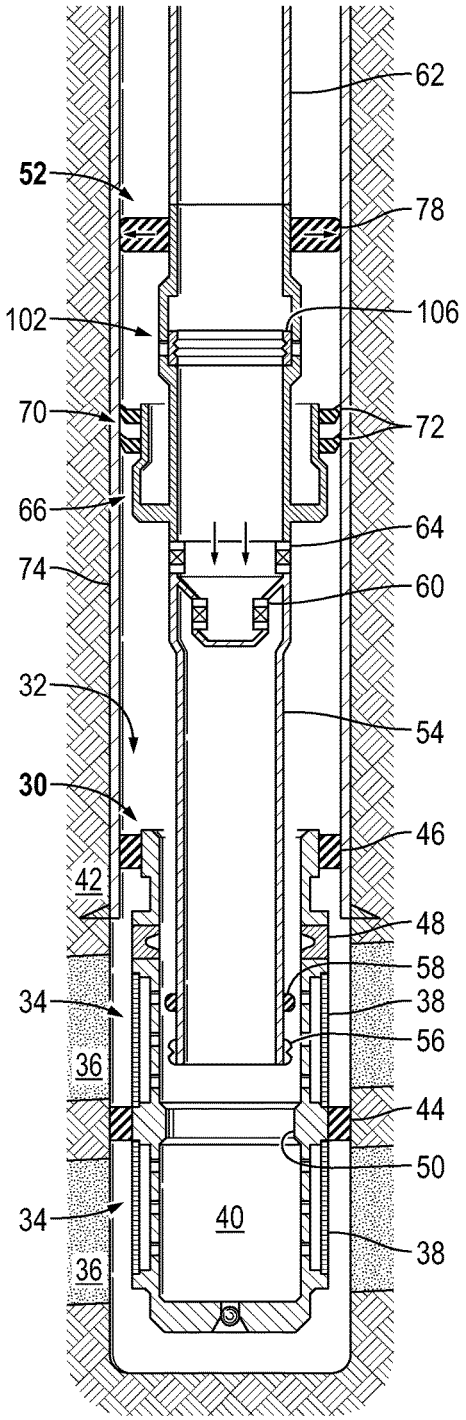
FIG. 13 is a schematic illustration of the embodiment illustrated in FIG. 10 in another operational configuration, according to an embodiment of the disclosure.
Figure 14:
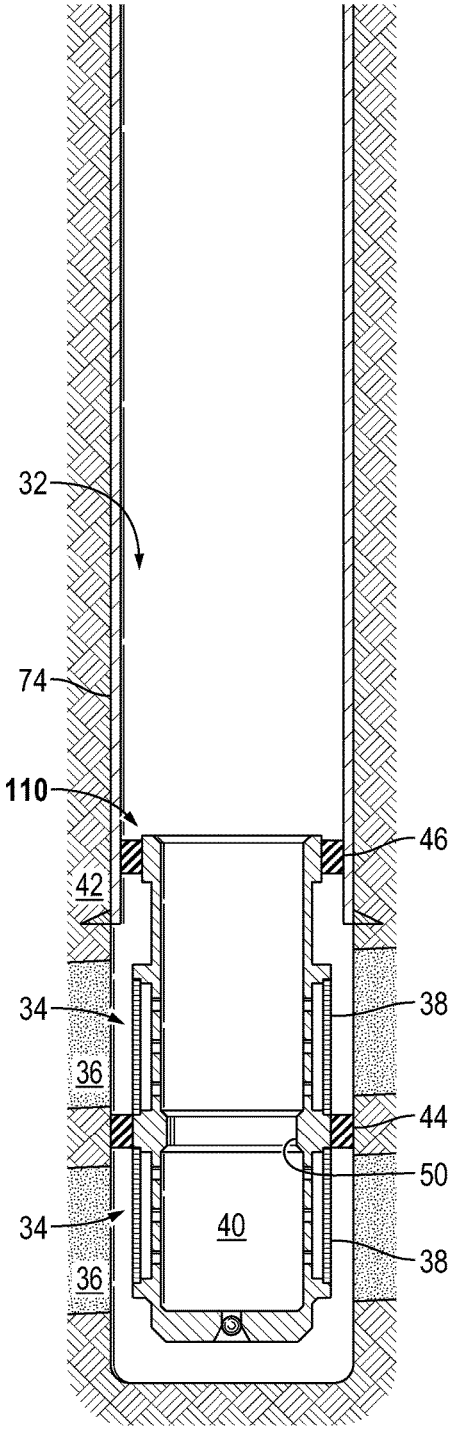
FIG. 14 is a schematic illustration of an example of a lower completion of a three trip completion, the lower completion having sand control assemblies, according to an embodiment of the disclosure.

Continued movement of upper completion 52 into engagement with lower completion 30 causes movement of seal assembly 58 into polished bore receptacle 50 of lower completion 30 to similarly form the overall completion system 100 in two trips. Seal assembly 58 forms a seal between tubing 54 of upper completion 52 and lower completion 30. After the upper completion 52 is sealably engaged with the lower completion 30, the lower flow control valve 60 may be closed with upper flow control valve 64 to enable application of pressure along the interior of production tubing string 62. The pressure in production tubing string 62 is sufficiently increased to set production packer 78 against the inside of well casing 74, as illustrated in FIG. 13.

In another embodiment, the overall completion system is deployed in three trips downhole. In this example, a lower three trip completion 110 is deployed downhole into wellbore 32. The lower completion 110 may again be a sand control completion having a plurality of the sand control assemblies 34 deployed along well zones 36, e.g. along a lower well zone and an upper well zone. Each of the sand control assemblies 34 comprises the sand screen 38 which filters out particulates from well fluid which flows into interior 40 of the completion from the surrounding formation 42. In the embodiment illustrated, the lower completion 110 may further comprise open hole isolation packer 44 and upper packer 46. The lower completion 110 also may comprise the simple polished bore receptacle 50 which may be located proximate isolation packer 44.

Figure 15:
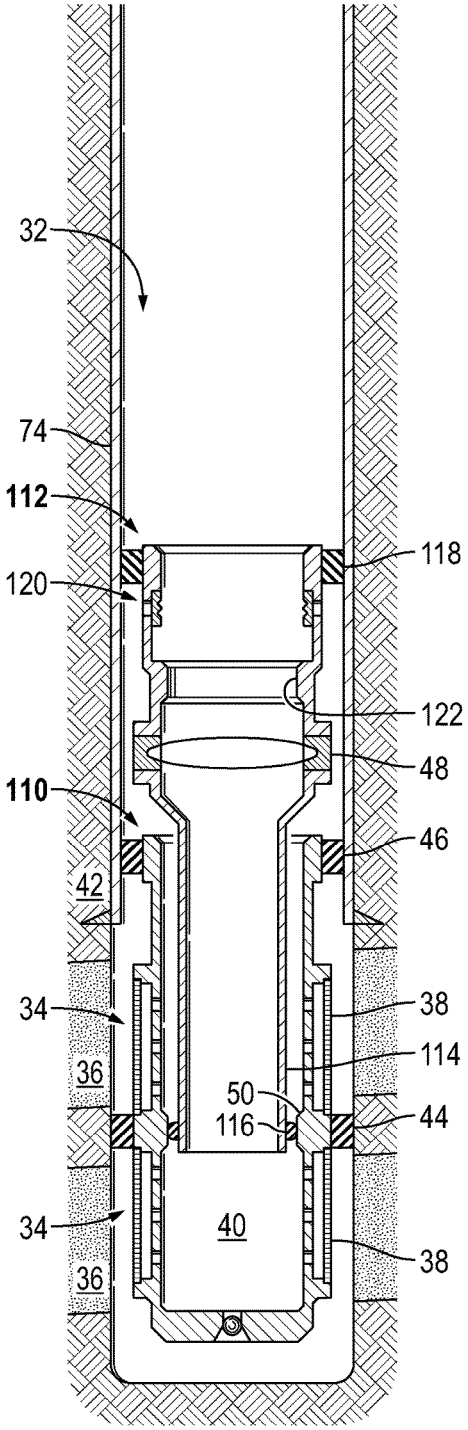
FIG. 15 is a schematic illustration of an intermediate completion being deployed into engagement with the lower completion, according to an embodiment of the disclosure.

Subsequently, an intermediate completion 112 is deployed downhole into engagement with lower completion 110, as illustrated in FIG. 15. By way of example, intermediate completion 112 may comprise a tubing 114 to which a seal assembly 116 is mounted for sealing engagement with polished bore receptacle 50. The intermediate completion 112 also may comprise other components, such as the mechanical formation isolation valve 48, a packer 118, and a sliding sleeve 120 (or other suitable device for controlling flow between an interior and exterior of intermediate completion 112) positioned between isolation valve 48 and packer 118. The sliding sleeve 120 also may be employed in some embodiments of lower completion 30, as illustrated in FIGS. 6-9. In the embodiment illustrated in FIG. 15, intermediate completion 112 also comprises an intermediate polished bore receptacle 122.

Figure 16:
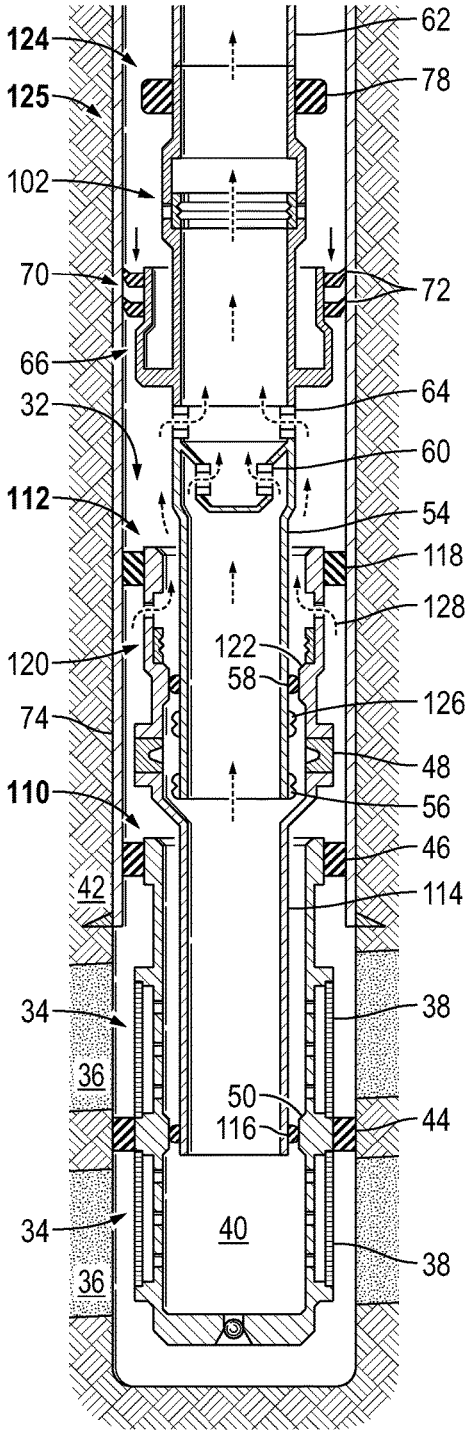
FIG. 16 is a schematic illustration of an upper completion, having a variety of upper completion and intelligent completion components, lowered into engagement with the intermediate completion, according to an embodiment of the disclosure.

As illustrated in FIG. 16, the three trip completion also comprises an upper completion 124 which is run downhole along wellbore 32 and into engagement with intermediate completion 112 to form an overall three trip completion 125. In the illustrated embodiment, the upper completion 124 comprises several components which are the same or similar to those of the upper completion 52 illustrated in FIG. 10 and those components have been labeled with common reference numerals. For example, upper completion 124 may comprise tubing 54 with seal assembly 58 and mechanical formation isolation valve shifting tool 56. However, a sliding sleeve shifting tool 126 also may be mounted on tubing 54. As tubing 54 is moved into intermediate completion 112, shifting tool 56 opens the mechanical flow isolation valve 48 and shifting tool 126 opens sliding sleeve 120 to enable communication between an interior and an exterior of intermediate completion 112, as indicated by arrows 128.

The upper completion 124 also may comprise lower zone flow control valve 60 and upper zone flow control valve 64, as described above. Additionally, the upper completion 124 may comprise fluid loss control device 66, on/off flow control valve 102, and production packer 78. In the example illustrated in FIG. 16, the fluid loss control device 66 is constructed without flow restrictors 68; and seal system 70 comprises upper and lower cup packers 72 which are oriented to seal from both directions, e.g. seal up and seal down. By way of example, both flow control valves 60, 64 may be placed in an open configuration to take returns through production tubing 62 while the upper completion 124 is landed in the intermediate completion 112.

Figure 17:
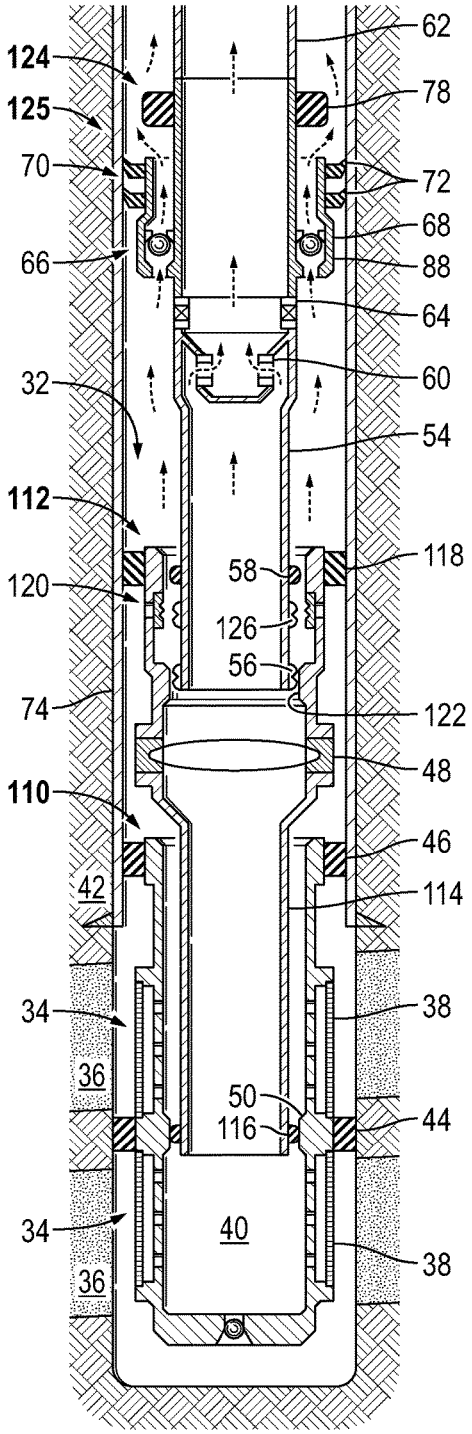
FIG. 17 is a schematic illustration similar to that of FIG. 16 but showing an upper completion with flow restrictors instead of the on-off flow control valve, according to an embodiment of the disclosure.

In another embodiment, the fluid loss control device 66 is constructed with a flow restrictor or a plurality of flow restrictors 68 instead of the on/off flow control valve 102, as illustrated in FIG. 17. By way of example, the embodiment of FIG. 17 may use a plurality of flow restrictors 68 in the form of check valves 88 which block downward flow while allowing upward flow. Please note that the description of downward flow and upward flow herein refers to the orientation of the figure and it should be appreciated that the completion system may be used in non-vertical wells where upward refers to the uphole direction and downward refers to the downhole direction. The flow restrictors 68 allow fluid to be routed upwardly past cup packers 72 and production packer 78 for flow along an exterior of production tubing string 62.

Figure 18:
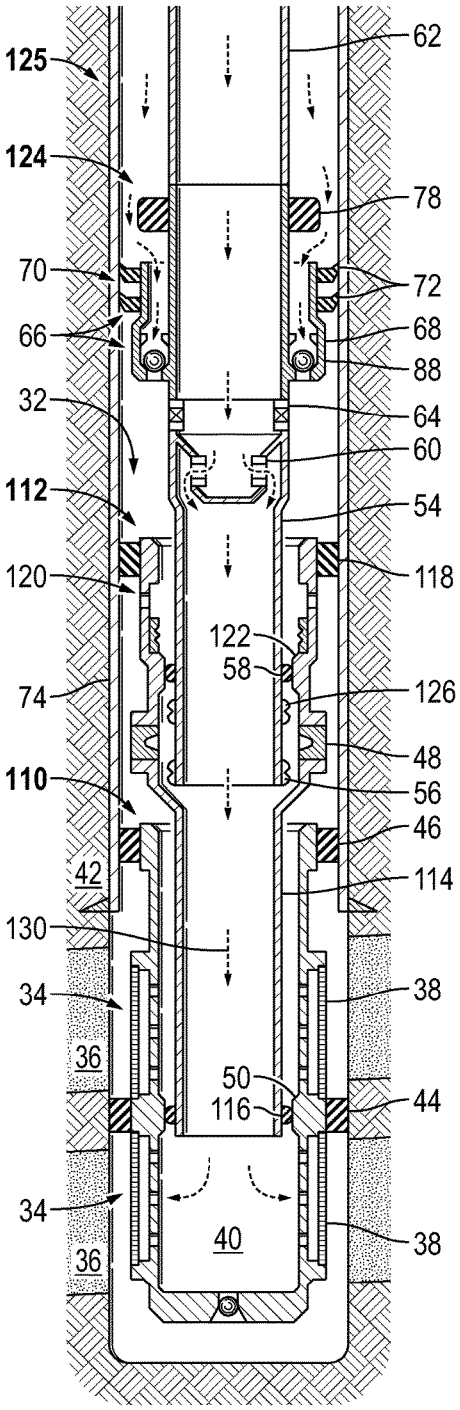
FIG. 18 is a schematic illustration of the three trip completion illustrated in FIG. 16 is an initial operational configuration, according to an embodiment of the disclosure.

As illustrated in FIG. 18, an option to provide fluid loss control in the three trip completion 125 is to bullhead fluid below the lower flow control valve 60 and the fluid loss control device 66 into the surrounding formation 42 after the sliding sleeve 120 and the mechanical flow isolation valve 48 have been opened. As described above, the sliding sleeve 120 and the mechanical flow isolation valve 48 may be opened via shifting tools 126 and 56, respectively, during passage through intermediate completion 112. The fluid is flowed down through production tubing string 62, down through tubing 54 and tubing 114, and out through screen assemblies 34, as represented by arrows 130.

Figure 19:
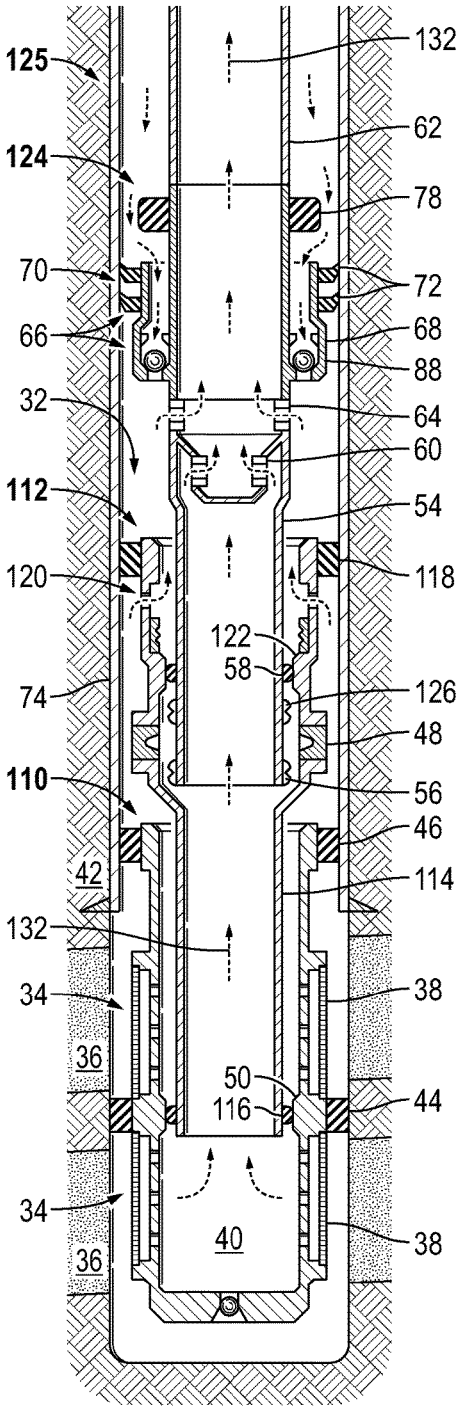
FIG. 19 is a schematic illustration of the three trip completion in another operational configuration, according to an embodiment of the disclosure.

However, another option is to open both lower zone flow control valve 60 and upper zone flow control valve 64 to take returns through production tubing string 62, as illustrated in FIG. 19. In this example, the sliding sleeve 120 and the mechanical flow isolation valve 48 have also been opened via shifting tools 126 and 56, respectively. The flow of returns into and through production tubing string 62 is continued until the upper completion 124 is fully landed in the intermediate completion 112. The return flows are represented by arrows 132 in FIG. 19.

Figure 20:
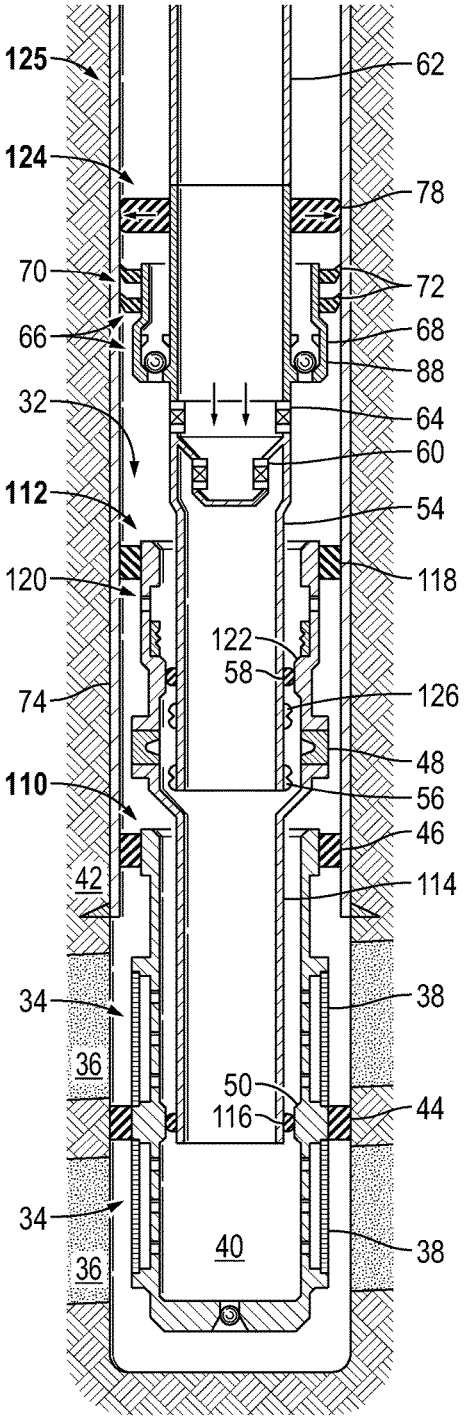
FIG. 20 is a schematic illustration of the three trip completion in another operational configuration, according to an embodiment of the disclosure.
Figure 21:
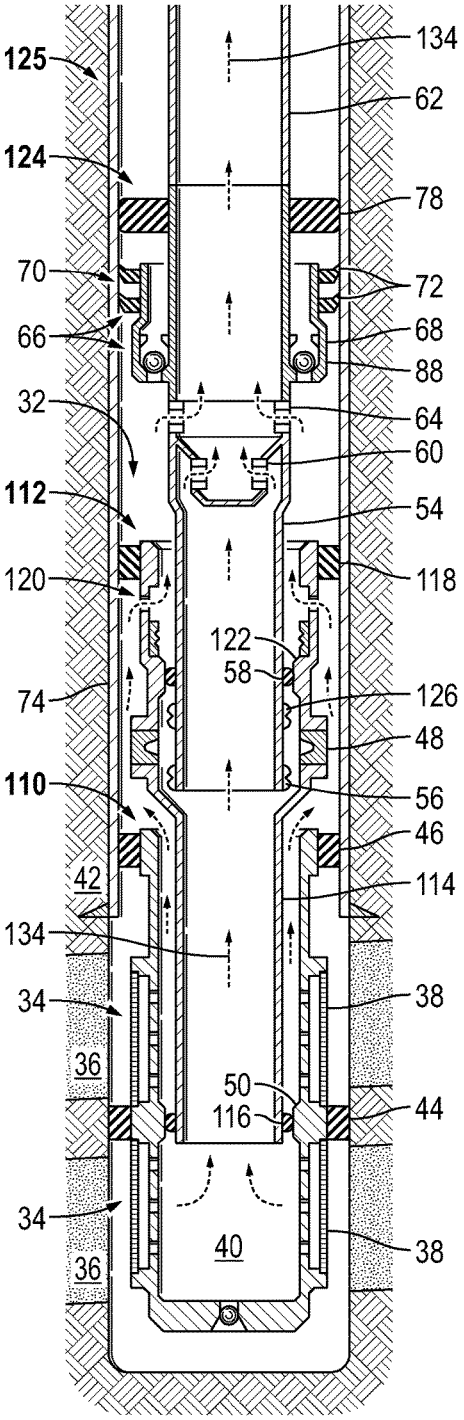
FIG. 21 is a schematic illustration of the three trip completion in another operational configuration, according to an embodiment of the disclosure.

After the upper completion 124 has been landed in intermediate completion 112, the upper zone flow control valve 64 and the lower zone flow control valve 60 are both closed. This allows pressure to be applied in production tubing 62 until sufficient pressure buildup is created to set the production packer 78, as illustrated in FIG. 20. Once the production packer 78 is set, the flow control valves 60, 62 may both be opened to enable production of fluids, e.g. hydrocarbon fluids, up through production tubing 62, as represented by arrows 134 in FIG. 21. The fluids, e.g. oil and/or gas, flow from zones 36 of formation 42 and into the overall completion 125 through screens 38 to enable production of the fluids to the surface or to another desired location.

The completion embodiments described herein may comprise many additional and/or other components than those in the examples illustrated. Additionally, the specific procedures for deploying the completions in two or three trips downhole may be adjusted according to the application, equipment, and/or environment. However, each of the embodiments described provides improved reliability by simplifying various components and procedures. In some embodiments, for example, conventional formation isolation valves and annular flow isolation valves may be removed. In place of such relatively complex devices, components such as mechanical flow isolation valves and mechanical sliding sleeves may be used and actuated via shifting tools delivered downhole with the upper completion. However, the specific configuration and arrangement of the valves, fluid loss control devices, packers, screen assemblies, and/or other components may be adjusted according to the parameters of a given application and environment.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A method for use in a well, comprising:

conveying a first completion downhole into a wellbore, the first completion having a mechanical formation isolation valve and a plurality of sand control assemblies;

positioning the sand control assemblies to receive well fluid from a plurality of corresponding well zones and a surrounding formation;

deploying a second completion downhole into the wellbore, the second completion comprising a shifting tool, a plurality of flow control valves, a fluid loss control device, a production packer located uphole of the fluid loss control device, and a production tubing;

sealing the fluid loss control device against a surrounding well casing downhole of the production packer via a seal system;

using a one-way flow device in the fluid loss control device to enable fluid flow along an annulus surrounding the second completion in an uphole direction while blocking fluid flow in a downhole direction; and shifting the mechanical formation isolation valve with the shifting tool as the second completion is moved into engagement with the first completion.

2. The method as recited in claim 1, wherein conveying comprises conveying the first completion downhole in a single trip.

3. The method as recited in claim 2, wherein deploying comprises deploying the second completion downhole in a single trip.

4. The method as recited in claim 1, wherein conveying comprises conveying the first completion downhole as a lower completion and an intermediate completion in two trips.

5. The method as recited in claim 4, wherein deploying comprises deploying the second completion downhole in a single trip.

6. The method as recited in claim 1, further comprising taking fluid flows through an interior of the production tubing by opening at least one of the flow control valves during movement of the second completion downhole into engagement with the first completion.

7. The method as recited in claim 1, further comprising placing at least one rupture disc in the fluid loss control device.

8. The method as recited in claim 1, further comprising flowing a fluid from the production tubing, out through a lower zone flow control valve of the plurality of flow control valves, up through the fluid loss control device, and past the production packer prior to fully engaging the second completion with the first completion.

9. A method, comprising:

locating a first completion in a wellbore;

deploying a second completion downhole toward the first completion, wherein deploying comprises deploying the second completion with a production packer and a fluid loss control device which forms a seal with a surrounding casing downhole of the production packer;

placing a check valve in the fluid loss control device to enable fluid flow along an annulus surrounding the second completion in an uphole direction while blocking fluid flow in a downhole direction;

using a shifting tool on the second completion to open a mechanical flow isolation valve on the first completion to provide a fluid communication path between a surrounding formation and the second completion; and sealably engaging the second completion with the first completion via a polished bore receptacle.

10. The method as recited in claim 9, further comprising moving fluid out into the formation after opening the mechanical flow isolation valve.

11. The method as recited in claim 9, further comprising taking fluid returns up through the second completion via an open flow control valve in the second completion after opening the mechanical flow isolation valve in the first completion.

12. The method as recited in claim 9, wherein locating comprises locating the first completion in two trips downhole to deploy a lower completion and an intermediate completion.

13. A system for use in a well, comprising:

a first completion having an open hole isolation packer, a plurality of sand control assemblies, a mechanical flow isolation valve, and a polished bore receptacle; and a second completion having:

a shifting tool to open the mechanical flow isolation valve during engagement of the second completion with the first completion;

a seal assembly positioned to sealably engage the polished bore receptacle;

a plurality of flow control valves corresponding with a plurality of well zones;

a production tubing in fluid communication with the plurality of flow control valves;

a production packer mounted on the production tubing;

a fluid loss control device having a seal system oriented to seal against a surrounding well casing intermediate the production packer and the plurality of flow control valves; and an on/off flow control valve selectively actuatable to control fluid flow between an interior of the second completion and a surrounding annulus, the on/off flow control valve and the fluid loss control device cooperating to selectively block or enable flow along the surrounding annulus prior to setting of the production packer.

14. The system as recited in claim 13, wherein the first completion comprises a lower completion and an intermediate completion.

* * * * *